United States Patent [19]

Hoberstorfer et al.

[11] 4,440,448

[45] Apr. 3, 1984

[54] METHOD FOR OPENING MINERAL DEPOSIT AND SUBSEQUENT MINING THEREOF

[76] Inventors: Gustav Hoberstorfer, 8 Vibblabyvägen, S-175 41 Järfälla; Torsten Norén, 8 Svalnäs allé, S-182 63 Djursholm, both of Sweden

[21] Appl. No.: 291,048

[22] Filed: Aug. 7, 1981

[30] Foreign Application Priority Data

Oct. 24, 1980 [SE] Sweden ..... 8007489

[51] Int. Cl.[3] ..... E21C 41/00

[52] U.S. Cl. ..... 299/11; 299/18; 299/19

[58] Field of Search ..... 299/11, 18, 19

[56] References Cited

FOREIGN PATENT DOCUMENTS

| | | | |
|---|---|---|---|
| 205772 | 2/1968 | U.S.S.R. | 299/11 |
| 636395 | 12/1978 | U.S.S.R. | 299/11 |
| 706536 | 12/1979 | U.S.S.R. | 299/11 |
| 827789 | 7/1981 | U.S.S.R. | 299/11 |

*Primary Examiner*—William F. Pate, III

*Attorney, Agent, or Firm*—Burns, Doane, Swecker & Mathis

[57] ABSTRACT

The invention relates to a new, generally applicable method for opening mineral deposits for prospection purposes and for subsequent mining, where necessary ramp systems, drifts or tunnels (developments), which previously were laid in dead rock, now entirely or substantially entirely are laid in the ore. The method further renders it possible, that the deposit can be predeveloped, i.e. that within the deposit different ore grades such as ore types and/or contents are exposed and made immediately and continuously accessible in such a manner, that the subsequent mining at every given occasion can be adjusted and controlled in the desired direction, whereby an adjustment to the market outlook can be made which is at optimum under the prevailing business situation. The method, therefore, must not only be regarded as a new method, which during the prospection phase of a deposit reduces the venture risk and during the subsequent mining maximizes the income, but also as an entirely new mining strategy, because the method produces ore, i.e. economically mined deposits of mineralizations which previously did not economically justify mining.

12 Claims, 12 Drawing Figures

METHOD FOR OPENING MINERAL DEPOSIT AND SUBSEQUENT MINING THEREOF

BACKGROUND AND SUMMARY OF THE PRESENT INVENTION

This invention relates to a method of opening, i.e. underground exploration, prospecting and developing (=preparation for mining) mineral deposits and of subsequently mining the mineral-bearing rock.

The method is based on refilling the greater part of openings resulting from driving operations in the mine with solid filling material, which preferably can be stabilized, such as sand, stone, dressing waste or the like. The desired stabilization, if required, is obtained by the addition of binding agents, such as cement, gypsum, certain types of slag or of dressing waste, iron pyrites, magnetic pyrites etc. or the like, or other substance and material capable of being transformed to stabilized state, possibly by trussing known per se or other reinforcement for achieving the object.

The method further is based on the feature that the parts of access roads which are located underground and have become unfit for use or entirely have been removed by mining, are replaced by new access roads. This replacement of access roads is brought about by recesses in the filling material masses, in such a manner, that suitable moldings are inserted in the filling material prior to the filling operation. The desired access roads subsequent to the addition of the filling material are obtained as "cores" in the moldings, i.e. as recesses. The method, further, has a potentially high mechanization degree and, consequently, a high capacity potential. In view thereof, and owing thereto, the method relates to the opening and possibly subsequent mining of mineral deposits by means of access roads, tunnels or drifts.

The term "mineral-bearing rock" or "mineral deposit" is to be understood as rock and, deposit containing any mineral or minerals, respectively but the term primarily refers to ore or coal, for example. For reasons of simplicity, hereinafter the term "ore" will be used.

In modern mining technology the necessary access and service roads in the form of ramps, tunnels, drifts (developments) to the deposit in question heretofore have been driven in adjacent dead rock. From these developments in dead rock then the deposit has been attacked and mined in various ways. It was deemed unsuitable to drive access and service roads (developments) in the ore, because by placing the developments in the ore sometimes a relatively great part of the deposit is blocked, viz. the part on or in which the developments are located. If, theoretically, even this blocked part of the ore would be mined, the developments and thereby practically the "footing" would be lost.

For natural reasons, the problem is accentuated in deposits of large vertical extension.

Several deviations from the aforesaid normal case, i.e. placing the necessary development work in surrounding dead rock, are known.

One such deviation is the mining of relatively flat ore deposits by the room and pillar method, provided that the combination of ore thickness and dip permit the developments to be placed to and in the ore. In such a case the development can be carried out by ramp systems or inclined shafts. As already indicated by its name, however, such a method generally implies ore losses in the form of pillars. This is directly contradictory to the object of the present invention, viz. a substantially complete ore recovery.

Other known deviations are the development and mining of deposits of relatively steep or vertical location by means of different forms and systems of shafts positioned to and in the ore.

In these cases the subsequent mining can be carried out by the cut-and-fill or shrinkage method, but only over a very limited ore volume and at low capacity, due to small mechanization possibilities. This is in direct contrast to the object of the present invention.

A third deviation are cases, in which the ore bodies outcrop along a mountain slope. This deviaton is an absolutely special case and, thus, in direct contrast to the present invention, which can be applied generally to all types of ore deposits. This implies that even deposits outcropping along a mountain slope can be worked by the present invention. In such a case the difference between known methods of working such deposits and the method according to the present invention lies in the mechanization and, thereby, in the capacity potential.

Due to the fact that development in dead rock involves expenditures and also implies delay of income to a later date compared with the time when the investment is made, a method adapted generally to be used for developments located in the ore and having a high capacity potential has been desired for a long time.

It is to be observed, that the magnitude of investment and the delay of income have an effect, which normally is an extremely great burden and in certain cases even decides on the being or not-being of a deposit. As in most cases a deposit prior to its development has been prospected only by diamond drilling or, at the best, by so-called mine prospection, investments made in the developments of mines to production state most often include certain elements of uncertainty and, therefore, are of a more or less risk-assuming character. Also the afore-mentioned initial mine prospection, which is carried out in order to reduce the risks of a possible subsequent expansion to production state, has a considerable risk-assuming character. It is apparent, for the above reasons, that it is desired to eliminate or at least reduce to a minimum the volume of necessary prospecting and developing work in dead rock and to carry out this work in the ore.

This has now been made possible by the present invention, at which the development required for the mining takes place entirely or to its greatest part in the mineral-bearing rock. The invention is characterized in that access and service ramps are driven inclined upward at ascending minig and inclined downward at descending mining, but preferably downward. A ramp system filled with stabilizing filling material may constitute the sole for a ramp system driven directly positively above the same, in such a manner, that the mining of ore located directly above the two ramp systems is carried out from an artificial sole, and the mining of ore located directly below the two ramp systems takes place beneath and under the protection by the ramp system filled with stabilizing filling material ("displaced development"). Alternatively artificial access and service systems may be driven and/or carried out in the stabilized refill, in such a manner, that within the range of at least two or more ramp systems, one ramp system, which at a certain occasion is blocked, normally by mining an ore slab from the system in question, and consequently cannot serve as a continuous communication path, in spite thereof is rendered possible for complete utilization along all of its extension, except for the blocking point proper, by alternating utilization in combination with at least one other ramp system.

The aforesaid refers to the developments required for the mining proper and, thus, does not refer to general access systems for obtaining physical contact with the ore body in question, unless this does outcrop.

The method is based on the method of refilling mentioned above in the introductory part. For this reason, the ore preferably is mined in horizontal slabs, preferably in downward mining direction. Each slab is made accessible for mining by at least two separate ramp systems which, however, do not necessarily have to exist simultaneously. The ramp systems are located in ore or in the previous ore zone when it is waste-mined and refilled.

The ramp systems, thus, may be "natural", i.e. "proper" driven ramps, drifts or tunnels in ore, or "artificial", i.e. brought about as recesses in the filling material inserted after the mining or, in certain phases of the mining operation, both natural and/or artificial ramps or parts thereof.

Mining, transport and necessary communication are carried out by using the aforesaid, at least two necessary ramp systems in such a way, that ore at a given occasion is hauled, and necessary communication is obtained by the ramp system, which at this occasion is not blocked by the current mining or for some other reason.

The method, as mentioned, is a filling method with preferably descending mining direction. Accordingly, roof reinforcement work is eliminated or reduced to a minimum (at descending mining). The admixture of dead rock is at minimum, because all work is carried out over a limited slice height under the protection of an artificial homogenous roof, and all loading work is carried out on a natural ore sole. Moreover, the term cut-and-fill mining generally implies a substantially complete ore recovery.

Ramp systems can be driven either as the mining operation proceeds or be completed entirely over the whole deposit or a suitable part thereof prior to the mining proper ("pre-development").

The latter alternatives are to be preferred, for the reasons as follows:

(a) By "pre-developing" the deposit, the prospecting volume in the form of diamond drilling can be reduced already during the prospecting phase, because the deposit henceforth is intended to be prospected in detail through driving ramps, tunnels, drifts in the ore. This implies, that the diamond drilling, which from an information aspect at times is unreliable, can be replaced to a large extent by ramps and ramp systems, i.e. instead of "micro" scale information material "macro" scale material is obtained.

It follows from the aforesaid that the diamond drilling initially referred to, which now can be reduced to a minimum, is required only for rendering it possible to decide whether or not an anomaly, which for example is found by geophysical measurements, is of continued interest, because the ramp systems smoothly can follow present ore contacts.

(b) By "pre-development", the optimum imaginable exposure and bulk sampling for necessary metallurgical studies and general planning are obtained.

(c) "Pre-development" yields income already during the prospecting phase, provided that metallurgical processing installations are available within economic transport distance, or a mobile dressing plant is used. Such mobile dressing plants are already commercially available.

(d) As indicated by the term "pre-development", the deposit is developed after completion of the prospecting phase for immediate mining over the same area which had been prospected.

(e) Due to the bulk sampling and exposure according to item (b) above and to the complete flexibility of the method, the subsequent mining can be planned continuously and be carried out at optimally.

Heretofore, the aforesaid advantages could not be achieved. Rather, these advantages are in contrast to what heretofore has been the case, viz. that a given mineral distribution within a deposit in connection with a selected development system has resulted in an almost unadvoidable predetermined production loss.

By the present method, however, the production can be controlled conditionally and continuously in accordance with any desired objective.

(f) "Pre-development" provides excellent possibilities of draining possible water from the deposit in question, which at times can be of decisive importance for the mining operation in general and for the strength of the filling material in cases when, for example, cement is used as binding agent.

The "artificial" ramp systems required for the method, i.e. ramp systems in the filling material, preferably are established as recesses in the filling material by suitable molding. The molding structures can be very simple. It is possible, for example, to use structures of wood and aluminum or of steel. The structures can be assembled and dismounted and are covered with steel network, chicken wire, plastic network or the like and, in addition, sack drill or the like. Another example is an inflatable flexible tube.

Alternatively, so-called "displaced development" is applied, i.e. the desired ramp system is established by utilizing a suitable number of "temporary" ramp systems, which subsequent to driving are filled with stabilizing filling material, whereafter these systems entirely or partially serve as protection for the permanent system and/or enclose the same.

The method is applied according to the principles as follows.

(a) With respect to the strike length of the deposit:

(1) Ores with short strike length are opened and mined later on by parallel ramp systems or ramp systems of displaced development, but preferably by the latter alternative.

(2) Ores with long strike length can, in addition to the aforesaid methods, be opened and mined later on by ramp systems placed one after the other in the strike.

(b) With respect to the width of the ore:

(1) Thin ores having a width corresponding to about the ramp width can be opened and mined later on by ramp systems with displaced development or placed one after the other in the strike.

(2) Wide ores can, in addition to the aforementioned methods, be opened and mined later on by diagonally intersecting or parallel ramp systems, provided that the ore width corresponds at least to twice the ramp width plus a temporary ore pillar located between the ramps. Parallel ramp systems, however, should be used to the greatest possible extent only in very wide ores.

When combining the above aspects, the following applies from a pracitcal point of view:

Ores with short strike length are opened and mined later on by ramp systems with displaced development, irrespective of the ore width.

Ores with long strike length or consisting of a plurality of successive, but isolated ore bodies, are prospected and mined by ramp systems placed one after the other in the strike, irrespective of the ore width, because this renders a capacity higher than at mining with ramp systems of displaced development.

In wide ores, i.e. ores with a width of at least twice the ramp width plus an intermediate pillar, which ores have a continuous strike length of about 150 m, the highest mining capacity is obtained by applying the method with diagonally intersecting ramp systems.

In ore bodies with great strike length, irrespective of the ore width, more than two ramp systems can be driven in the stirke direction of the ore, so that a sequence of multiple ramp systems is obtained. This arrangement results in a great number of attack points and, thus, in a high mining capacity.

The same applies in principle in vertical direction, because only one of the at least two ramp systems, or a continuous combination of the at least two systems capable to communicate at every given occasion is required.

The same principle also applies to the ore width, because the ramp systems can be multiplied in width if the ore width so permits.

In this case, however, the same effect can be achieved from only one double ramp system by simultaneously opening a plurality of mining stopes on the same level. The advantage of multiple double ramp systems in the width of the ore, therefore, should be restricted to only achieving increased flexibility.

For being able to utilize in practice the capacity potential referred to above, accurate planning is required. A vertical chute system from the mining stopes, or in connection thereto, to a haulage level on the lowest level in the ore and with a shaft-based haulage system in connection therewith, is a further requisite. At vertical haulage heights of about 200 m, it is an absolute requirement.

These haulage shafts, both vertical and inclined ones, depending on the dip of the body can be placed entirely or partially in ore or as recesses in the filling material similar to the ramp systems.

The mining technology heretofore available and utilized, i.e. developments in dead rock, mining of wide ore bodies by downward cut-and-fill method, generally was not deemed economically justified. These ores have been mined by using other methods, which cause high dead rock admixture or high ore loss or normally a combination of these two.

By the present method the prerequisites are changed, because the higher expenditure caused by the stabilized filling material is well compensated for by substantially insignificant development costs as well as by reduced dead rock admixture and ore loss. This applies provided that the ore value is relatively attractive. At low ore values economic results should be obtained.

As appears from the aforesaid, in all cases in practice at least double ramp systems are established, probably multiples of double systems. This fact, together with the possibility of being able to simply establish recesses in desired direction and of desired dimension in the filling material, results in extremely flexible prerequisites for supplying and removing the necessary ventilation air in an effecient and simple manner.

What applies to ventilation, also applies to safety aspects regarding the necessary number of evacuation and, respectively, supply roads from and to the mining places.

The aforesaid aspects also apply as regards installation, changes and general flexibility of necessary service systems, for example for electricity, compressed air, water, distribution of filling material, etc.

BRIEF DESCRIPTION OF THE DRAWINGS

The invention is described in detail in the following, with reference to the accompanying drawings, in which.

DETAILED DESCRIPTION OF THE PREFERRED EMBODIMENTS

Figure 1A:
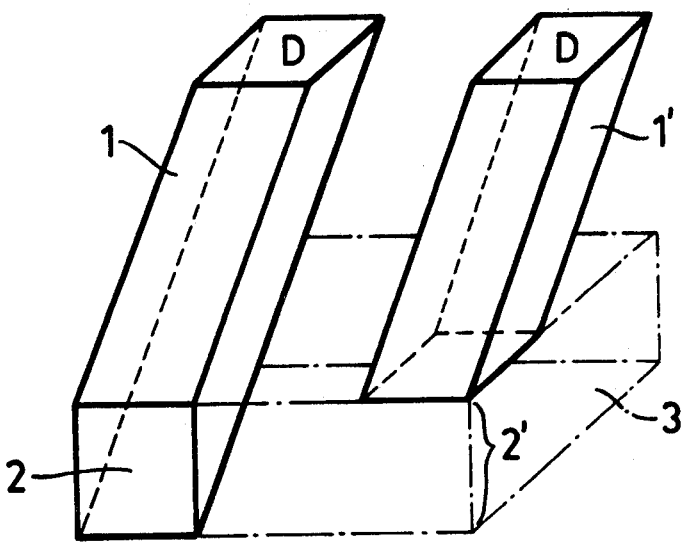
FIGS. 1*a*–1*d* are schematic perspective views of the measures described above with parallel ramp systems.

In FIG. 1*a* a ramp 1 is driven from open cut D down to one longitudinal half 2 of the ore through the uppermost ore slab with slab height 2'. A parallel ramp 1' simultaneously is driven down to the upper defining surface of the second half 3.

Figure 1B:
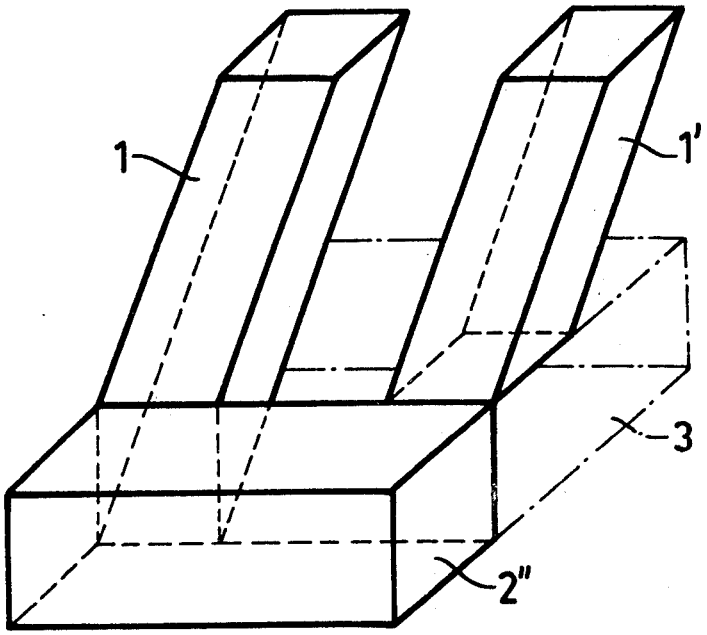

From the ramp 1 a cut-through 2'' is made to the second half 3 as shown in FIG. 1*b*.

Figure 1C:
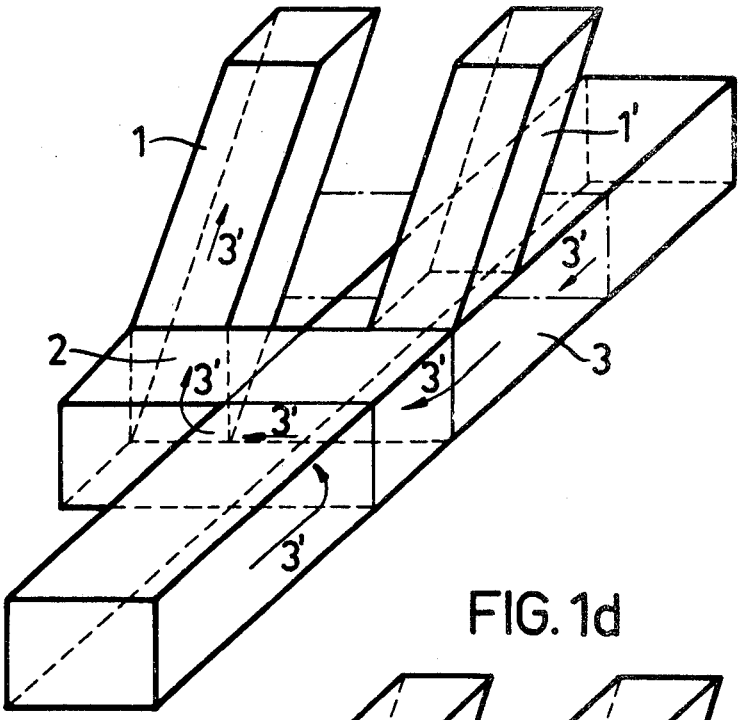

The half 3 is waste-mined, and the ore is hauled via the cut-through 2'' upward through the ramp 1, as indicated by arrows 3' in FIG. 1*c*. Thereafter, a suitable molding is installed in the waste-mined half 3, and after the half 3 has been filled with a suitable stabilized filling material, the molding constitutes an artificial ramp, which has connection to the ramp 1'.

Figure 1D:
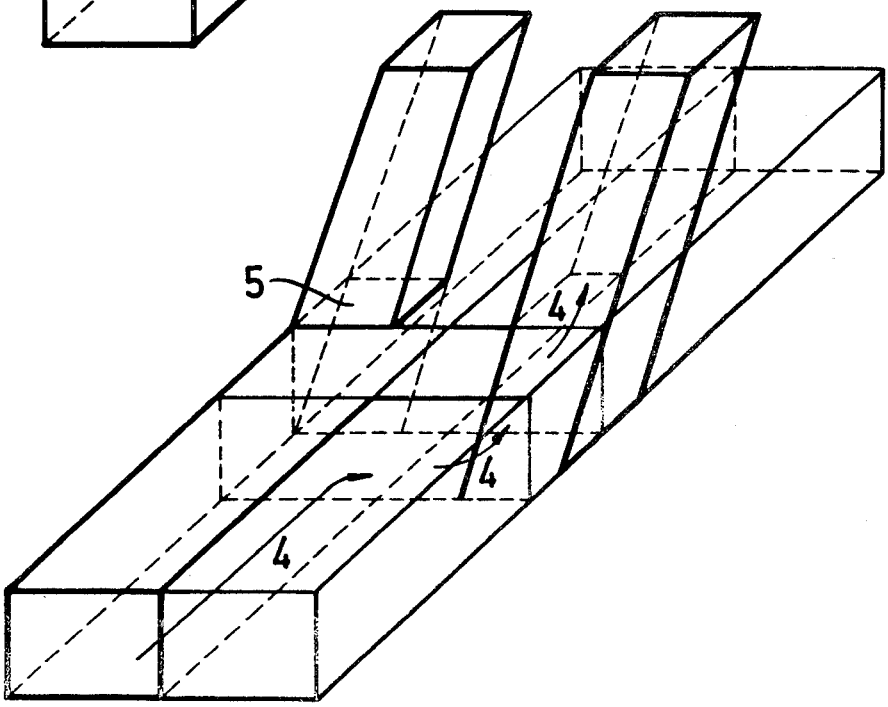

From this artificial ramp then the half 2 is mined, and the ore is hauled through the ramp 1', as shown in FIG. 1*d* by arrows 4. After completed mining of the half 2, a suitable molding similar to that mounted previously in the half 3 is mounted to form an artificial ramp 5. Thereafter the half 2 is filled with stabilized material. The method is repeated as long as the ore deposit permits.

It is possible, as mentioned, to establish necessary ramp systems by so-called "displaced development". This implies, that a permanent ramp system is brought about by applying temporary systems, which are refilled after driving and entirely or partially surround the future permanent system. The permanent system, thus, is a previous rock core in a whole or partial enclosure of stabilized filling material.

Figure 2:
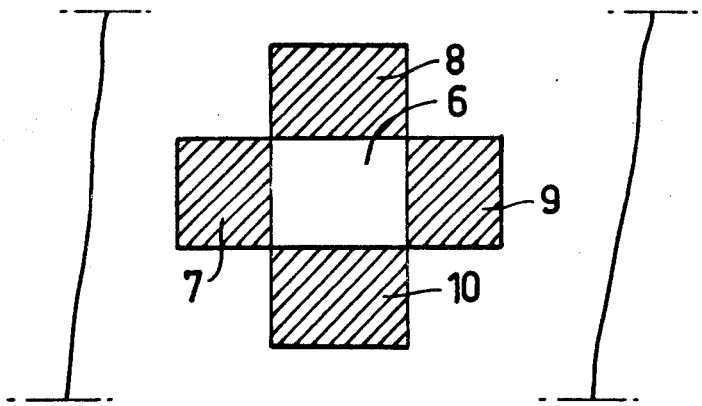
FIG. 2 is a schematic representation of the principle of generating "permanent ramp systems" by "temporary" systems, i.e. the basic principle of "displaced" development.

The method is shown schematically in FIG. 2 where the future permanent ramp 6 is surrounded by the temporary ramps 7,8, 9 and 10 driven and refilled. The permanent system, thus, is a core surrounded by the temporary systems 7,8,9 and 10.

The method can be used in very large ores. The subsequent mining then can be carried out without using stabilized filling material. In this case, however, not all of the advantages mentioned above are obtained.

Figure 3:
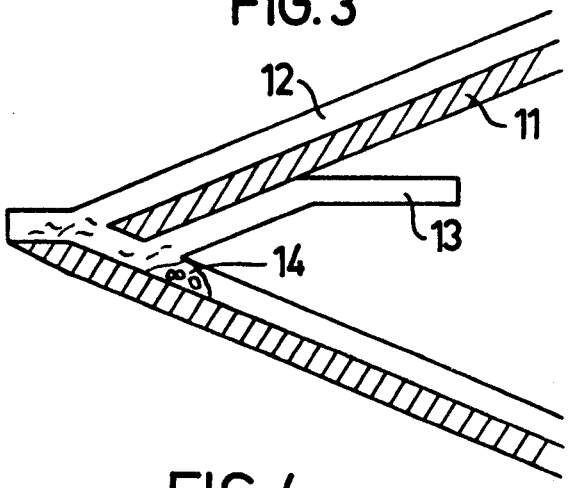
FIG. 3 is a schematic view of "displaced development" and the principle of mining ores of very short strike length.

FIG. 3 shows schematically the mining of ores of a very short strike length by means of "displaced development". In FIG. 3, thus, the ramp system 11 has been driven and refilled by a stabilized filling material whereafter the ramp system 12 was driven literally directly above the ramp system 11, which now had converted to an inclined "concrete beam". Communication to the mining place 13 is obtaind by blasting down an appropriate rock portion 14. The mining place 13, thus, is reached at under the protection of the concrete beam, and the output is hauled first beneath the concrete beam and then by using the beam as roadway.

Figure 4:
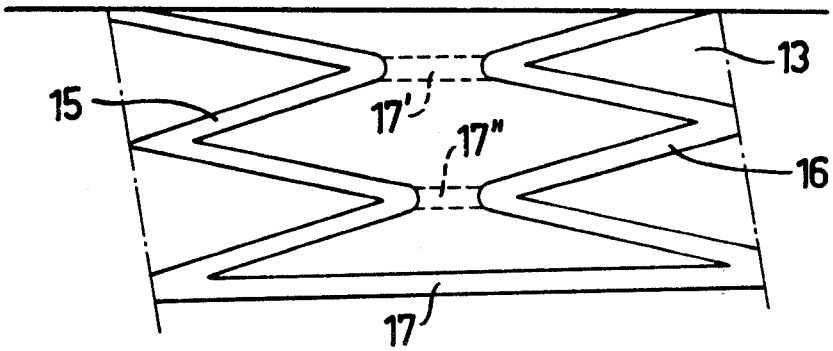
FIG. 4 is a schematic view of mining according to above of ores with long strike length, or a plurality of successive separate ore lenses.

FIG. 4 shows schematically the arrangement of several ramp systems in the longitudinal direction of the ore body. The Figure shows two ramp systems 15 and 16. The systems are located one after the other in zigzag pattern. For providing the necessary communication, the systems are connected by a longitudinal ramp 17 (cut-through) and, when required, by the ramps 17' and 17'' (cuts-through). When permitted by the strike length of the ore bodies, several such ramp systems can be driven, thereby yielding a high output capacity. The embodiment according to FIG. 4 is especially important at the mining of several successive ore lenses. The lenses are mined, for example, with a ramp system in each ore lens with the ramp systems being connected by horizontal (or inclined) ramps between the lenses.

Figure 5:
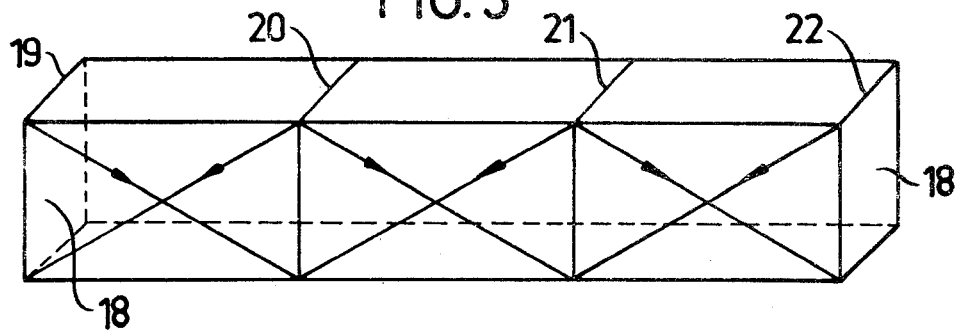
FIG. 5 is a schematic view of multiple double ramp systems.

FIG. 5 shows schematically how a very high mining capacity can be obtained at an ore 18, which here for reason of simplicity is shown as a parallelepiped with several attack points 19,20,21,22.

Figure 6:
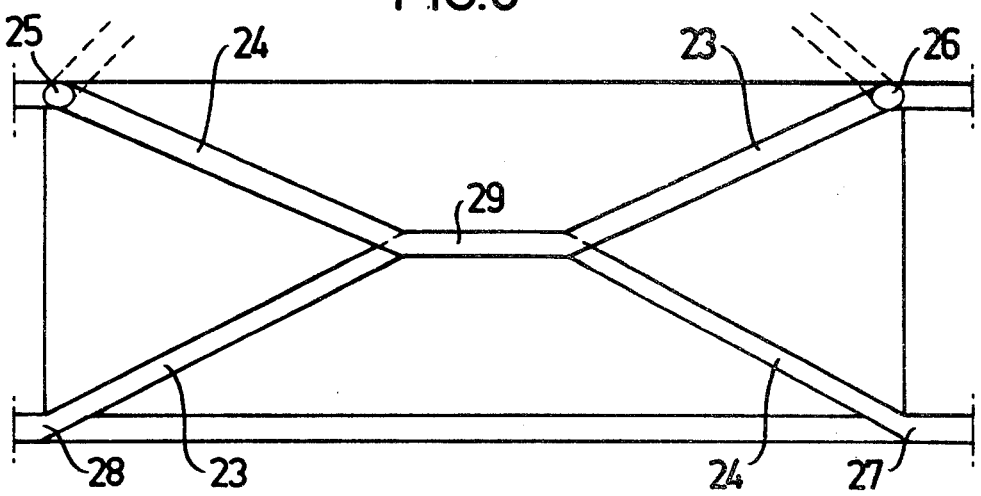
FIG. 6 is a schematic vertical section of the principle of mining with diagonally intersecting ramp systems.
Figure 7A:
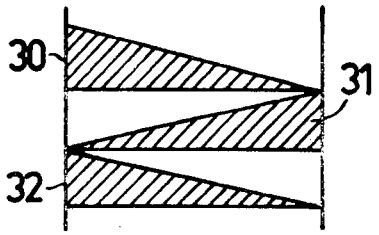
FIGS. 7*a*–7*c* are schematic views of an arrangement for reducing the use of stabilized filling material by a combination of the use of stabilized and non-stabilized filling material whereby, if desired, also artificial ramp systems can be avoided.
Figure 7B:
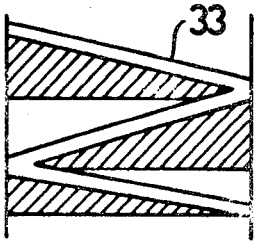
Figure 7C:
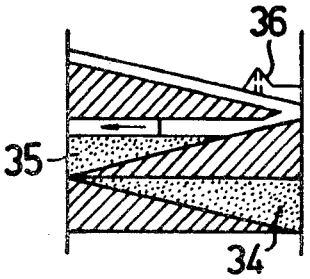

In FIG. 6 the principle of mining by intersecting ramp systems is shown. The principle is based on the diagonally "intersecting" ramps 23 and 24 in such a way, that one ramp is available when the other ramp is mined. Analogous with the mining shown in FIG. 1, artificial ramps are established in the filling material by the installation of suitable moldings.

It appears from FIG. 6, that the ore triangle 25,26,27 can be mined from the ramp 24, the triangle 25,26,28 from the ramp 23 and, finally, the triangle 27,28,29 from a combination of the ramps 23 and 24 by arranging a cut-through in the ore between the points 27 and 28.

In order to reduce the volume of stabilized filling material, a method according to FIGS. *7a–7c* can be applied which, however, restricts the flexibility of the method.

In FIG. *7a*, from an original ramp system the triangles 30,31,32 located in the "foot wall", i.e. beneath the system, are mined from the system in question in downward direction by using stabilized filling material. In FIG. *7a* these ore triangles 30.31,32 are shown waste-mined and refilled with stabilized filling material. The original ramp system is replaced, FIG. *7b*, in phase with mining operations by an artificial ramp system newly 33 or, when desired, by a system driven above the filling material mentioned previously. In the next step the triangles in the "hanging wall" of the ramp, i.e. the ore portions 34,35,36 located above the ramp system 33, are mined in upward direction, FIG. *7c*, with normal non-stabilized filling material.

FIG. *7c*, thus, shows the ore triangle 34 waste-mined, the ore triangle 35 being mined, and the ore triangle 36 remaining to be mined.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What we claim is:

1. A method for opening a mineral deposit and subsequent mining of mineral rock including refilling with solid stabilizing filling materials and obtaining necessary and desirable stabilization by addition of binding agents or other reinforcement, a development required for the mining being positioned at least substantially entirely in the mineral rock, comprising the steps of driving inclined access and service ramps in one of an upward and a downward direction, establishing artificial access and service ramp systems in the stabilizing filling material, alternately utilizing the ramp systems such that within the range of at least two ramp systems, one ramp system, which at a given occasion is blocked by the mining of an ore slab from the one ramp system and cannot serve as a continuous communication link, is utilized along its entire distance except for the blocking point proper by alternating use between the one ramp system and another ramp system within the range.

2. A method for opening a mineral deposit and subsequent mining of mineral rock including refilling with solid stabilizing filling materials and obtaining necessary and desirable stabilization by addition of binding agents or other reinforcement, a development required for the mining being positioned at least substantially entirely in the mineral rock, comprising the steps of driving inclined access and service ramps in one of an upward and a downward direction, refilling a first ramp system with the stabilizing filling material to form an artificial floor for a second driven ramp system located directly thereabove, carrying out mining of ore located directly above the two ramp systems from the artificial floor, and carrying out mining of ore located directly beneath the two ramp systems beneath and under the first ramp system refilled with stabilizing filling material.

3. The method as defined in claim 1 or 2, wherein the ramp systems are produced as recesses in the filling material supplied after the mining of a corresponding region.

4. The method as defined in claim 1 or 2, wherein the at least two ramp systems are driven in succession in a longitudinal direction of an ore body of the mineral deposit and are displaced such that intersections are avoided, and establishing necessary communication between the ramp systems by a suitable number of transverse connections between the systems.

5. The method as defined in claim 1 or 2, wherein the mineral deposit includes a plurality of ore lenses, and comprising the steps of placing a ramp system within each ore lens, and establishing necessary communication by a suitable number of transverse connections between the systems of the ore lenses.

6. The method as defined in claim 1 or 2, wherein a combination of at least a portion of the ramp systems are utilized for ventilation, safety purposes and the drawing of necessary conduit and supply systems.

7. The method as defined in claim 1 or 2, wherein the mineral deposit includes differentiated grades of ore, further comprising utilizing temporarily desirable and economically most favorable grades of ore, and maintaining temporarily unfavorable grades for mining at a later date.

8. The method as defined in claim 1 or 2, wherein the mineral deposit includes ore bodies with long strike length, and further comprising driving a plurality of ramp systems to obtain a sequence of intersecting ramp systems, whereby high mining capacity is achieved.

9. The method as defined in claim 1, further comprising obtaining necessary permanent ramp systems by driving suitably placed temporary systems, refilling the temporary systems with stabilizing filling material, driving the permanent ramp system between a temporary system located above and a temporary system located below.

10. The method as defined in claim 1 or 2, wherein the at least two ramp systems are driven in parallel.

11. The method as defined in claim 1 or 2, wherein the at least two ramp systems are driven diagonally intersecting.

12. The method as defined in claim 1, further comprising obtaining necessary permanent ramp systems by driving suitably placed temporary systems, refilling the temporary systems with stabilizing filling material, and driving the permanent ramp systems above the filled temporary systems.

* * * * *